United States Patent [19]

Minor

[11] 4,390,267

[45] Jun. 28, 1983

[54] BI-MODAL ILLUMINATION APPARATUS

[75] Inventor: James C. Minor, Rochester, N.Y.

[73] Assignee: Eastman Kodak Company, Rochester, N.Y.

[21] Appl. No.: 350,651

[22] Filed: Feb. 22, 1982

[51] Int. Cl.[3] ..... G03G 15/00

[52] U.S. Cl. ..... 355/14 E; 355/67; 355/75

[58] Field of Search ..... 355/14 E, 67–71, 355/75, 76, 35–38, 3 R

[56] References Cited

U.S. PATENT DOCUMENTS 3,885,166 5/1975 Moser et al. ..... 355/75
4,090,108 5/1978 Johnson et al. .
4,239,374 12/1980 Tatsumi et al. ..... 355/14 E

FOREIGN PATENT DOCUMENTS 2059086 4/1981 United Kingdom .

OTHER PUBLICATIONS

Xerox Disclosure vol. 3, No. 1, Jan./Feb. 1978.

*Primary Examiner*—R. L. Moses
*Attorney, Agent, or Firm*—Raymond L. Owens

[57] ABSTRACT

Flash lamps operate in two modes depending upon the position of the platen cover of a copier. In the first mode, the platen cover is closed and a short duration relative high-peak intensity flash pulse illuminates a document at the exposure platen. In the second mode, the cover is raised or opened to accommodate a three-dimensional object, such as a magazine or book, and a flash pulse having a longer time interval but lower peak intensity is provided.

2 Claims, 4 Drawing Figures

BI-MODAL ILLUMINATION APPARATUS

CROSS-REFERENCE TO RELATED APPLICATION

Reference is made to commonly assigned U.S. Pat. Application Ser. No. 137,149 filed Apr. 4, 1980, entitled Copy Contrast and Density Control to Fiske et al.

FIELD OF THE INVENTION

The present invention relates to copier illumination apparatus for the exposure of a document image on a copier photoconductor.

BACKGROUND OF THE INVENTION

Copiers are often provided with an exposure platen cover which may be raised above the platen to accomodate copying of a single document from a three-dimensional object, such as a magazine or book or an oversized drawing. See, for example, U.S. Pat. Nos. 3,630,620 and 4,110,041. The exposure of an image on a photosensitive element such as a photoconductor is a function of the area under an Intensity (I) vs time(t) curve. When document images are exposed on a moving photoconductor, it is desirable to use flash lamps which produce a flash pulse that illuminates a document at the platen. Light reflected off the document exposes the photoconductor. Preferably, the duration of the flash pulse is made short to minimize image smear on the photoconductor. There is a practical limit as to how short the duration of the flash pulse can be made, which depends upon the construction of the flash lamps and driving power supply. A pulse with a short time period necessarily has high peak intensity to provide the appropriate exposure. An example of the exposure of an image on a photoconductor of a typical document by such a flash pulse is shown in FIG. 3. However, if the cover is raised, an operator's eye can be subjected to the high-peak intensity light. To protect an operator from potential eye damage, manufacturers have reduced the peak intensity of a pulse and increased the time period of the flash pulse. An example of the exposure of an image of a typical document on a photoconductor by this longer flash pulse is shown in FIG. 4. For a specific example, for the same document at the exposure platen, if the areas under the curves of FIGS. 3 and 4 are substantially the same, a photoconductor will be subject to the same exposure, whichever flash pulse is used. The period and intensity of this longer flash pulse can be determined empirically so that it causes exposure of an image on a photoconductor of a typical document which will provide copies, without appreciable image smear. There is a practical limit as to how long the duration of the flash pulse can be made, which depends upon the response characteristics of the photoconductor and the velocity which the photoconductor moves past the exposure platen during exposure.

SUMMARY OF THE INVENTION

This invention is concerned with operating an exposure station in two modes of operation. The first mode is effective when the exposure platen cover is closed and a high-peak intensity, short duration flash pulse is used to expose a photoconductor. When the exposure platen cover is open, the second mode is effective. In this mode, the peak intensity of the pulse is reduced but the pulse duration is increased to protect the operator from potential eye damage. Copies of a document produced by the first mode of operation will have less image smear than copies of the same document produced by the second mode of operation.

DESCRIPTION OF THE PREFERRED EMBODIMENT

Figure 1:
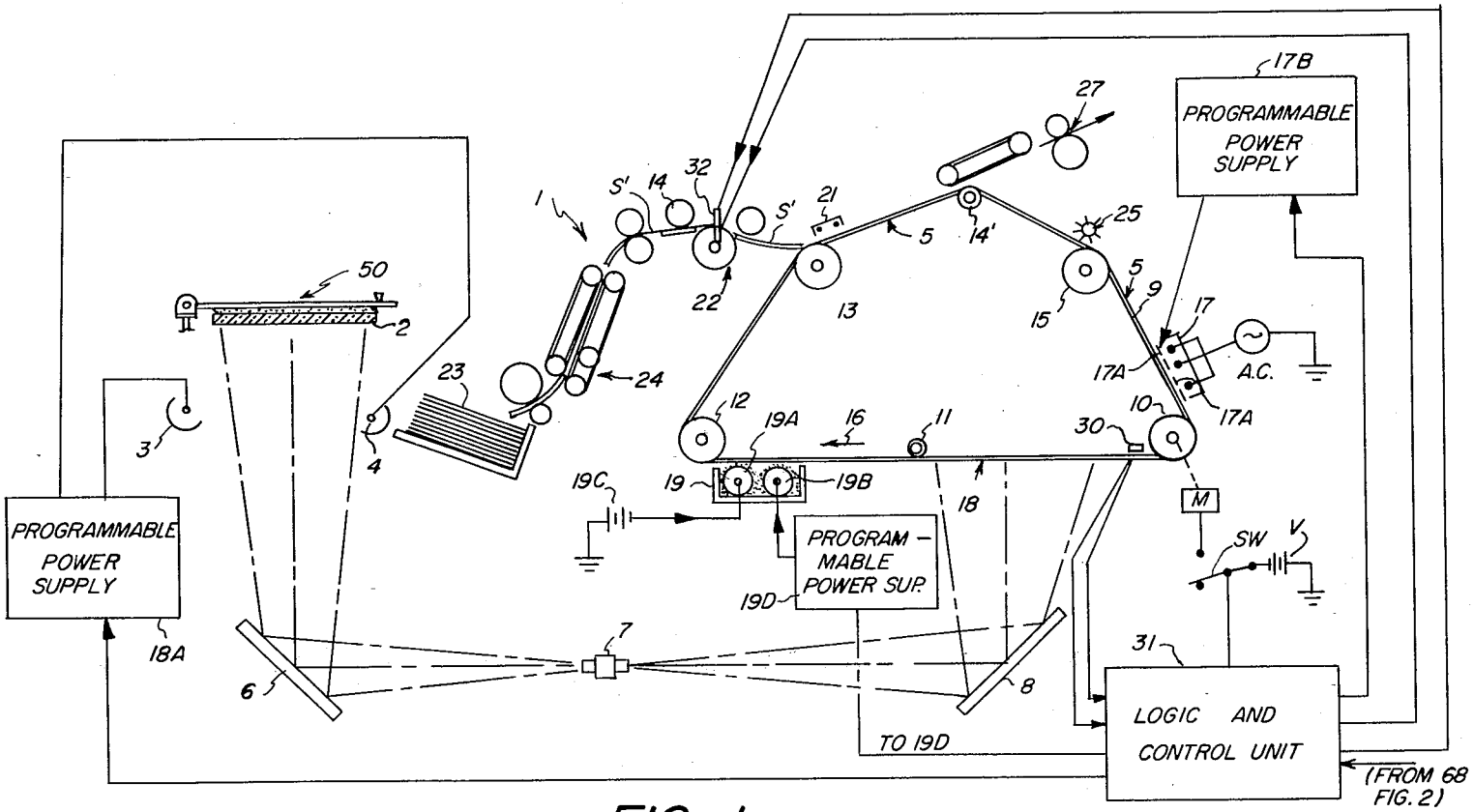
FIG. 1 is a schematic showing a side elevational view of a copier with a platen cover and a logic and control unit in accordance with the invention.

To assist in understanding the present invention, it will be useful to consider an endless web electrophotographic copier 1 having a logic and control unit.

A photosensitive or photoconductor element, shown as a photoconductive web 5, includes a photoconductive layer with a conductive backing on a polyester support. The photoconductive layer may be formed from, for instance, a heterogeneous photoconductive composition such as disclosed in commonly assigned U.S. Pat. No. 3,615,414, issued Oct. 24, 1971. The web 5 is trained about six transport rollers 10, 11, 12, 13, 14', and 15, thereby forming an endless or continuous belt having a plurality of image areas. For more specific disclosures of such a web 5, see commonly assigned U.S. Pat. Nos. 3,615,406 and 3,615,414, both issued Oct. 26, 1971. Roller 10 is coupled to a drive motor M is a conventional manner. Motor M is connected to a source of potential V when a switch SW is closed by a logic and control unit (LCU) 31. The switch SW is shown in its open position. When the switch SW is closed, the roller 10 is driven by the motor M and moves the web 5 in clockwise direction as indicated by arrow 16. This movement causes successive image areas of the web 5 to sequentially pass by copier work stations. It will be appreciated by those skilled in the art that the LCU 31 includes a programmable microprocessor. Programming of a number of commercially available microprocessors such as INTEL model 8085 microprocessor which along with others can be used in accordance with the invention, is a conventional skill well understood in the art. The following disclosure is written to enable a programmer having ordinary skill in the art to produce an appropriate intensity control program for the microprocessor. The particular details of any such program would, of course, depend on the architecture of the designated microprocessor.

For the purpose of the instant disclosure, several copier work stations controlled by the LCU are shown along the web's path. These stations will be briefly described. For more complete disclosures of them, see commonly assigned U.S. Pat. No. 3,914,047.

First, a charging station 17 is provided at which the surface 9 of the photoconductive layer of the web 5 is sensitized by applying to such surface an electrostatic charge of a predetermined voltage. The station 17 includes an A.C. charger shown as a three wire A.C. charger. The output of the charger is controlled by a grid 17A connected to a power supply 17B. The supply 17B is in turn controlled by the LCU 31 to adjust the voltage level Vo applied onto the surface 9 by the charger 17. For an example of digital regulation of a corona charger, see U.S. Pat. No. 4,166,690.

At exposure station 18, the inverse image of the document S is projected onto the surface 9 of the web 5. The image dissipates the electrostatic charge at the exposed areas of the surface 9 and forms a latent electrostatic image on such surface 9. A programmable power supply 18A, under the supervision of the LCU 31, controls the intensity and duration of light from neon flash lamps 3 and 4. It will be appreciated by those skilled in the art that for any given document, the LCU 31 can control the output of the lamps 3 and 4 to shape of the Intensity vs. time curve (exposure curve), which are measured at the surface 9. For a specific example of such an exposure station and programmable power supply, see commonly assigned U.S. Pat. No. 4,150,324, issued Aug. 8, 1978 to Seil.

A dual magnetic brush developing station 19 includes developer mixture, having iron carrier particles and electroscopic toner particles with an electrostatic charge opposite to that of the latent electrostatic image. For a specific example of such a developer, see commonly assigned U.S. Pat. No. 3,893,935 issued July 8, 1975 to Jadwin et al. The developer is brushed over the photoconductive surface 9 of the web 5 and toner particles to adhere to the latent electrostatic image to form a visible toner particle, transferable image. The dual-magnetic brush station 19 includes two rollers, a transport roller 19A, and a developer roller 19B. As is well understood in the art, each of the rollers 19A and 19B include a conductive (non-magnetic) applicator cylinder which may be made of aluminum. For a specific disclosure of a dual magnetic brush which can be used in accordance with the invention, see commonly assigned U.S. Pat. No. 3,543,720. See also commonly assigned U.S. Pat. Nos. 3,575,505; 3,654,893; and 3,674,532 for disclosures of biasing development station rollers.

The copier 1 also includes a transfer station shown as a corona charger 21 at which the toner image on web 5 is transferred to a copy sheet S'; and a cleaning station 25, at which the photoconductive surface 9 of the web 5 is cleaned of any residual toner particles remaining after the electroscopic images have been transferred and any residual electrostatic charge is discharged.

As shown in FIG. 1, a copy sheet S' is fed from a supply 23 to continuously driven rollers 14, (only one of which is shown) which then urges the sheet against a rotating registration finger 32 of a copy sheet registration mechanism 22. The driving action of the rollers 14 cause a sheet to buckle against the finger 32 and when the finger releases from the sheet, the sheet moves forward onto the photoconductor in alignment with a toner image at the transfer station 21.

After transfer of the unfixed electroscopic images to a copy sheet S', such sheet is transported to fuser 27 where the image is fixed to it.

To coordinate operation of the various work stations 17, 18, 19, 21, and 25 with movement of the image areas on the web 5 past these stations, the web has a plurality of perforations along one of its edges. These perforations generally are spaced equidistantly along the edge of the web member 16. For example, the web member 5 may be divided into six image areas by F perforations; and each image area may be subdivided into 51 sections by C perforations. The relationship of the F and C perforations to the image areas is disclosed in detail in commonly assigned U.S. Pat. No. 3,914,047. At a fixed location along the path of web movement, there is provided suitable means 30 for sensing F and C web perforations. This sensing produces input signals into the LCU 31 which has a digital computer, preferably a microprocessor. The microprocessor has a stored program responsive to the input signals for sequentially actuating then de-actuating the work stations as well as for controlling the operation of many other machine functions as disclosed in U.S. Pat. No. 3,914,047.

As shown in FIG. 1, a platen cover 50 is positioned on top of a transparent glass, exposure platen 2 of the copier 1. When energized, the two xenon flashlamps 3 and 4 produce a flash pulse which illuminates a document through the platen 2. For a specific disclosure of a typical exposure station, see commonly assigned U.S. Pat. No. 3,998,541, issued Dec. 31, 1976. By means of an object mirror 6, lens system 7, and an image mirror 8, an image of the illuminated document is optically stopped on discrete image areas of the moving photoconductive web 5 at exposure station 18.

Figure 2:
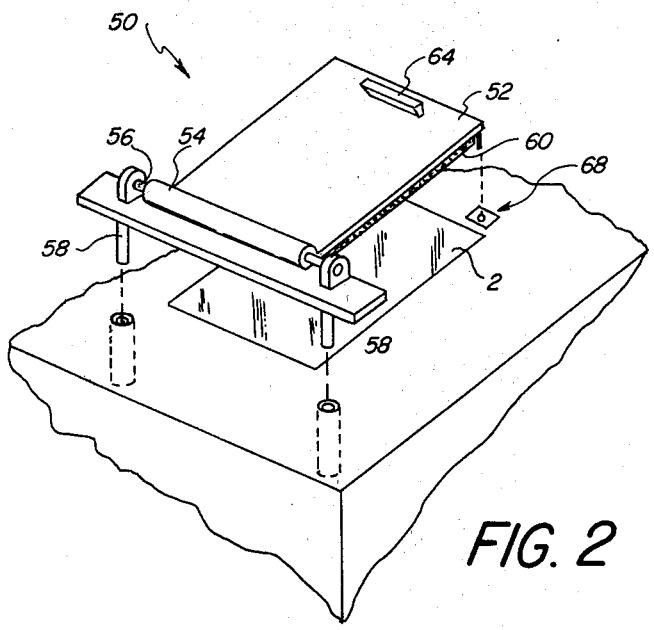
FIG. 2 is a schematic of the platen cover shown in FIG. 1.

Platen covers are well known in the art and take various forms. For example, see the platens disclosed in U.S. Pat. No. 4,124,296 to Kishi et al and the platen cover disclosed in U.S. Pat. No. 4,110,041 to Luperti et al. In FIG. 2 a schematic representation of a platen cover is shown. The platen cover 50 includes a rigid member 52 which has one end pivotably secured by means of a hinge 54 to a stationary shaft 56. The shaft is fixed to pin members 58 which are slidably mounted in receiving holes of the copier frame. On the interior surface of the rigid member 52, there is provided a white opaque member 60 made of an elastic material such as foam polyurethane, polystyrene, polyethylene, polychloride, or the like. A three-dimensional object having a predetermined thickness may be held by member 60 against the platen 2 with sufficient pressure to cause a document in the object to lay flat against the platen. When a single sheet document is to be copied, a handle 64 is raised, the sheet placed on the platen, and the cover placed over the document. In this position, a switch 68 is closed. The switch 68 is as shown in FIG. 1 connected to the logic and control unit 31. However, when a three-dimensional object such as a book has a document to be copied, the handle 64 is grasped and the entire platen cover is raised. The cover is then placed on top of the document. In this position, the switch 68 is open.

Figure 3:
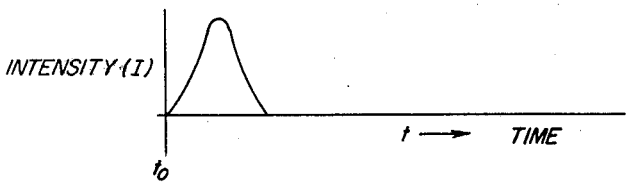
FIGS. 3 and 4 set forth graphs which illustrate two different Intensity (I) vs time(t) curves (exposure curves) of the same document at the exposure platen of the copier of FIG. 1.
Figure 4:
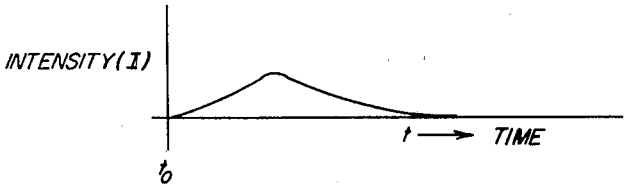

The logic and control unit 31 controls power supply 18A to selectively produce two different flash pulses which cause the exposures of the same document, depicted in FIGS. 3 and 4 respectively. The FIG. 3 exposure is used when the cover is closed. The flash pulse which produces this exposure has a high peak intensity and is of short duration. Since the cover is closed, the intensity of light escaping from the platen will not be hazardous to an operator's eyes. However, if the cover were open, the increase in the intensity of light which escapes might be harmful. In accordance with the invention, when the cover is open, a longer time period lower intensity flash pulse is used which produces the exposure shown in FIG. 4. With the cover raised, the intensity of light escaping from the platen during the flash pulse is reduced so that it will not be harmful to an operator's eyes. When switch 68 is closed, it provides a signal to the LCU 31. In response to this signal, the power supply produces exposure of a document such as represented by FIG. 3. When the switch 68 is open, an open circuit signal is provided to the LCU 31 and the LCU causes the exposure of the document such as represented by FIG. 4 to be produced.

The invention has been described with particular reference to a preferred embodiment thereof, but it will be understood that variations and modifications can be effected within the spirit and scope of the invention.

I claim:

1. In apparatus having a photosensitive element, an exposure platen for receiving a document to be illuminated, an opaque cover movable between a closed position for covering a document at said exposure platen and an open position to accommodate at the platen a three-dimensional object such as a magazine or book which includes such a document and lamp means effective when energized for producing light which is reflected off a document at said exposure platen to expose said photosensitive element, the improvement comprising:

(a) switch means responsive to said cover when in said closed position for producing a first signal and responsive to said cover when in said second position for producing a second signal; and (b) illumination control means responsive to said first signal for energizing said lamp means to illuminate a document at said exposure platen with light of relatively high-peak intensity and short duration and responsive to said second signal for energizing said lamp means to illuminate a document at said exposure platen with light of longer duration and lower peak intensity than said first illumination.

2. In a copier having a moving photosensitive element, a transparent exposure platen for receiving a document to be illuminated and an opaque platen cover movable between a closed position for covering a document on said exposure platen and an open position to accommodate a three-dimensional object such as a magazine or book which includes such a document, a programmable power supply, at least one flash lamp coupled to said supply and effective when energized by said supply for producing a flash pulse which is reflected off of a document at the exposure platen to expose said photosensitive element, the improvement comprising:

(a) switch means responsive to said exposure platen cover in said closed position for producing a first signal and responsive to said platen cover in said second position for producing a second signal; and (b) illumination control means coupled to said supply and responsive to said first signal for causing said supply to energize said flash lamp to cause it to produce a first high-peak intensity, short duration, flash pulse, said control means responsive to said second signal for causing said supply to energize said flash lamp to produce a second flash pulse having a longer time interval than said first pulse but at a lower peak intensity.

* * * * *